US006626095B1

(12) United States Patent
Nugent

(10) Patent No.: US 6,626,095 B1
(45) Date of Patent: Sep. 30, 2003

(54) CAN RECYCLING SYSTEM

(76) Inventor: David Nugent, 5861 88th St., #100, Sacramento, CA (US) 95828

( * ) Notice: Subject to any disclaimer, the term of this patent is extended or adjusted under 35 U.S.C. 154(b) by 0 days.

(21) Appl. No.: 09/896,724

(22) Filed: Jun. 29, 2001

(51) Int. Cl.[7] ..... B30B 15/32
(52) U.S. Cl. ..... 100/902; 100/245; 100/218; 100/215
(58) Field of Search ..... 100/902, 245, 100/251, 215, 218, 224 R, 226, 214; 241/99

(56) References Cited

U.S. PATENT DOCUMENTS 4,213,384 A * 7/1980 Telling ..... 100/74
4,771,686 A * 9/1988 Triantos, Jr. ..... 100/255
5,325,771 A * 7/1994 Morris ..... 100/37
5,752,439 A * 5/1998 LaMora, Jr. ..... 100/229 A
5,819,644 A * 10/1998 Coffelt ..... 100/49

* cited by examiner

*Primary Examiner*—Allen Ostrager
*Assistant Examiner*—Shelley Self
(74) *Attorney, Agent, or Firm*—Bielen, Lampe & Thoeming

(57) ABSTRACT

An apparatus for collapsing and collecting a can utilizing a tray having a first portion with a surface and a second portion with an opening through the same. A housing is also provided and includes a press which is movable between a first position and a second position. The tray is guided relative to the housing such that the surface of the first portion lies opposite the press and is capable of collapsing a can when placed on the first tray portion. When the press moves to its first position the can is collapsed. The collapsed can passes through the tray when the tray second portion lies opposite the press.

11 Claims, 2 Drawing Sheets

CAN RECYCLING SYSTEM

BACKGROUND OF THE INVENTION

The present invention relates to a novel and useful can recycling system.

Cans are employed to package foods and beverages to a large degree throughout the world. Most cans are constructed of metallic materials which are capable of being compressed following removal of the foodstuff from therewithin for the purpose of recycling the same. In the past, many methods have been used to collapse cans such as manually operated mallets, machine presses, or simply the force exerted by the human foot or hand. Following collapsing of the can, further steps are required to package the can into a recycling container such as a flexible bag, a barrel, and the like.

A system for recycling cans which may be used to collapse and collect cans in an efficient manner would be a notable advance in the recycling field.

BRIEF SUMMARY OF THE INVENTION

In accordance with the present invention a novel and useful system for recycling cans is herein provided.

The system of the present invention utilizes an apparatus for collapsing and collecting cans. The apparatus includes a tray which may be formed with a first portion having a surface and a second portion with an opening therethrough. The first portion surface possesses sturdiness to permit the support of a can when pressure is applied to the can for the purposes of collapsing the same. Likewise, the opening through the second portion of the tray is capable of passing a collapsed can under the influence of gravity.

The apparatus of the present invention also includes a housing. The housing includes a ground or wall support and a mounting surface. The housing mounting surface is fitted with a press that is movable between a first position and a second position. Moreover, the housing provides a guide for the tray to allow the tray to move such that the first portion or the second portion, thereof, is located beneath the press. When the press lies opposite the first portion and the surface of the first portion of the tray, the press movement to its first position at least partially collapses the can. Advancement of the tray to allow the second portion to position beneath the press permits the collapsed can to pass through the opening of the second portion.

The invention also includes a container and means for holding the container to the tray. The container is held at the portion of the tray beneath the opening of the second portion. Thus, when a can is collapsed by the press, the movement of the tray second portion to a position beneath the press will permit the collapsed can to drop into the container. The container may be sized to force stacking of the collapsed cans within the container. That is to say, the inside diameter of the container may be slightly larger than the width of a collapsed can. The means for holding the container to the tray may include a flange extending from the tray which is capable of engaging the container. The flange may be formed with a slot that interacts with a rim on the container, allowing the container to slide into position and to be held by the tray. When the container is filled with collapsed cans, it may be slid from the slot of the tray and emptied or shipped to a recycling facility.

It may be apparent that a novel and useful can recycling system has been hereinabove described.

It is therefore an object of the present invention to provide a can recycling system which includes an apparatus for collapsing and collecting cans.

Another object of the present invention is to provide a can recycling system in which collapsed cans are containerized in an efficient and simple manner.

A further object of the present invention is to provide a can recycling system which is simple to operate and maintain.

A further object of the present invention is to provide an apparatus for collapsing and collecting cans which is compact and portable for use in various environments.

The invention possesses other objects and advantages especially as concerns particular characteristics and features thereof which will become apparent as the specification continues.

For a better understanding of the invention reference is made to the following detailed description of the preferred embodiments thereof which should be referenced to the prior described drawings.

DETAILED DESCRIPTION OF THE PREFERRED EMBODIMENTS OF THE INVENTION

Various aspects of the present invention will evolve from the following detailed description of the preferred embodiments thereof which should be taken in conjunction with the hereinabove described drawings.

Figure 1:
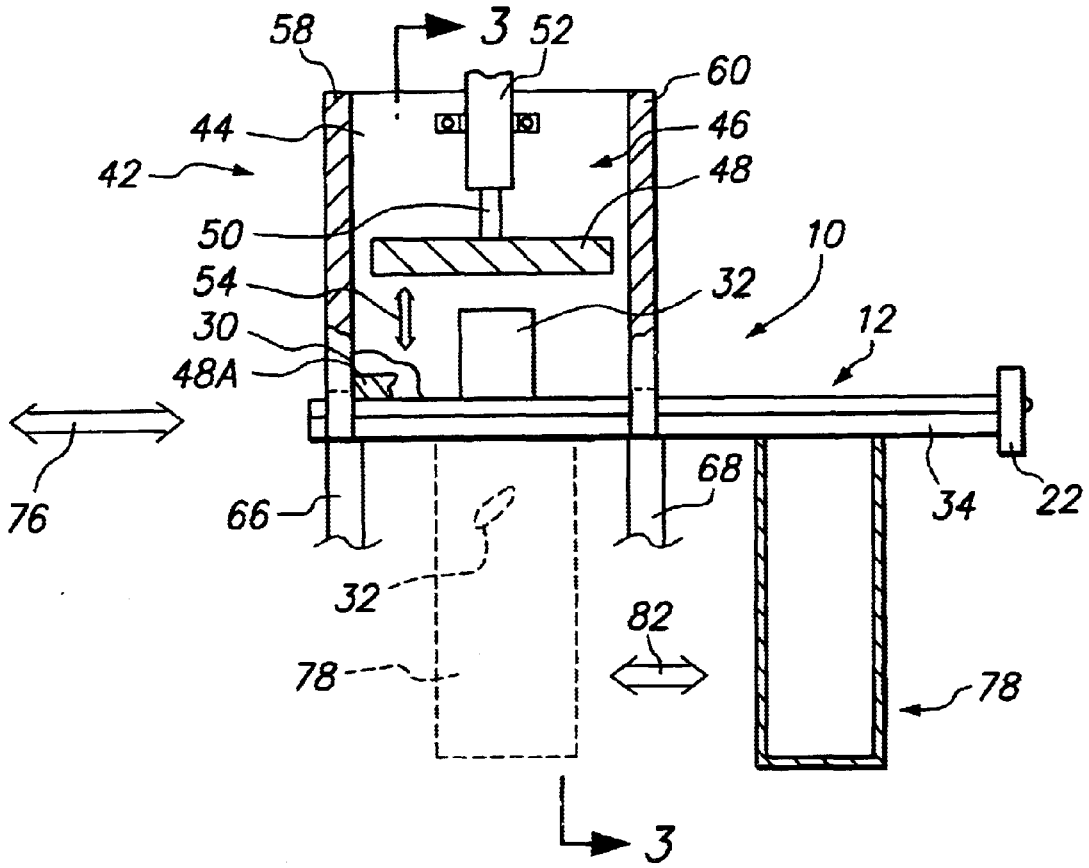
FIG. 1 is a sectional view showing the housing and tray portions of the apparatus of the present invention.
Figure 2:
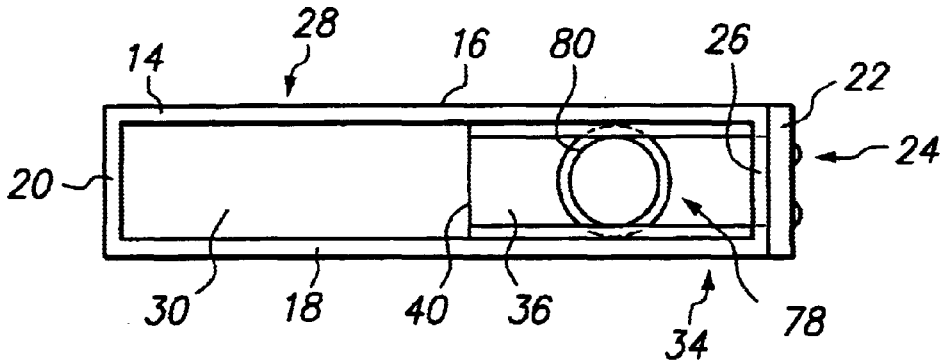
FIG. 2 is a top plan view of the tray portion of the apparatus of the present invention.

The invention as a whole is shown in the drawings by reference character 10. The apparatus 10 includes as one of its elements a tray 12. The tray includes a frame member 14 having side portions 16 and 18. End portions 20 and 22 connect to side portions 16 and 18 to form a generally rectangular structure. End portion 22 is removable by the use of fasteners 24 which hold end portion 22 against bar 26, best shown in FIGS. 1 and 2. Tray 12 possesses a first portion 28 having a solid surface 30. As depicted in FIG. 1, solid surface 30 is capable of supporting can 32, which his shown in FIG. 1 in its uncollapsed configuration. Surface 30 is fixed to frame 14 by any suitable means such as welding, gluing, fasteners, and the like. Tray 12 also possesses a second portion 34. Second portion 34 includes an opening 36 therethrough. Second portion 34 of tray 12 also provides a track 38. As shown in FIG. 1, track 38 extends the entire length of tray 12, however track 38 may end at edge 40 of surface 30.

Housing 42 is also found in apparatus 10 of the present invention. Housing 42 forms an open chamber 44 which at least partially encloses a press 46. Press 46 is constructed with a piston 48 that moves upwardly and downwardly through the extension of shaft 50 from hydraulic cylinder 52, directional arrow 54. Hydraulic cylinder 52 may be controlled by standard means (not shown). A partial rendition of piston 48 (piston 48A) is depicted in FIG. 1 to show the first position of piston 48 against surface 30. The full rendition of piston 48 in FIG. 1 shows piston 48 in the second position. Needless to say, piston 48 in its first position will at least partially collapse can 32 against surface 30.

Figure 3:
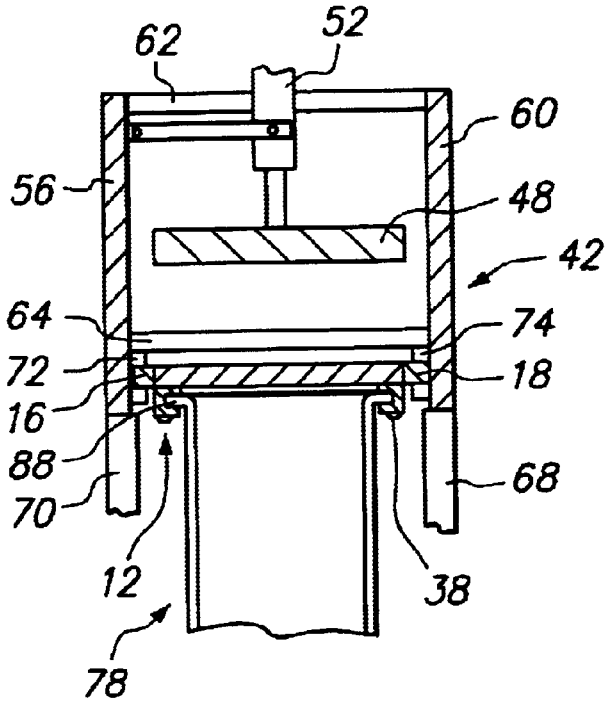
FIG. 3 is a sectional view taken along line 3—3 of FIG. 1.

Turning to FIG. 3, it may be seen that housing 42 includes a back wall 56 and a pair of posts 58 and 60. Back wall 56 provides a mounting surface for hydraulic cylinder 52. Cross members such as cross members 62 and 64 hold posts 58 and 60 to back wall 56 of housing 42. It should be noted that another pair of cross members (not shown) hold post 58 to back wall 56. Housing 42 rests on stanchions 66, 68, 70, and one not shown. The stanchions are supported on a ground surface to hold housing 42 in an elevated position. Housing 42 may also be supported to a fixed vertical structure. Brackets 72 and 74 on wall 56 and posts 60, as well as another bracket associated with post 58 (not shown) permits tray 12 to slide relative to housing 42 according to directional arrow 76.

Figure 4:
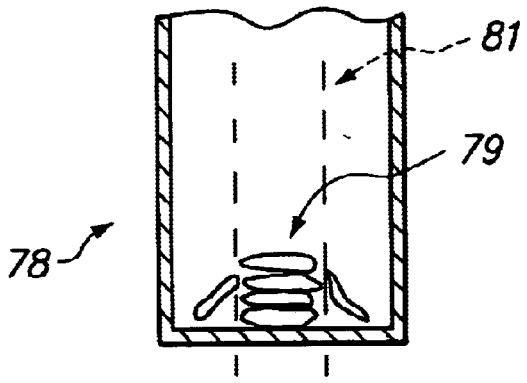
FIG. 4 is a sectional view of a partial portion of the container of the present invention depicting stacked collapsed cans.

Apparatus 10 also possesses, as one of its elements, a container 78. Container 78 fits within track 38 and is fixed thereto by friction or by fasteners. Access to track 38 is gained by the removal of end portion 22 by the use of fasteners 24. Thus, second portion 34 of tray 12 may be moved beneath press 48 as shown in phantom on FIG. 1. Container 78 may be formed in any size and configuration. However, container 78 is depicted in the drawings as a cylindrical member including a rim 80 that fits within track 38. In addition, the size of container 78 may be altered such that collapsed cans passing through opening 36 of second portion 34 of tray 12 are capable of stacking one on top of another as shown by plurality of cans 79 on FIG. 4. Dashed lines on FIG. 4 represent a constricted configuration 81 of container 78 for this purpose.

In operation, the user activates hydraulic cylinder 52 to lift piston 48 into its second position shown in whole on FIGS. 1 and 3. Tray 12 slides relative to housing 42 via brackets 72, 74, and one not shown, directional arrow 82, such that surface 30 lies beneath piston 48. Can 32 is then placed under piston 48. Hydraulic cylinder 52 is reactivated to lower piston 48 into its first position, indicated by piston 48 on FIG. 1, to collapse or crush can 32. Tray 12 and container 78 are then slid beneath piston 48 to allow crushed can 32, shown in phantom on FIG. 1, to drop through opening 36 and into container 78. Can 32 remains in chamber 44 during this operation. Container 78 is then retracted again to allow crushing of subsequent cans. Again, container 78 will then be moved into place beneath piston 48 to gather subsequent crushed cans for storage. Once container 78 is full, it may be removed from track 38 and replaced with an empty similar container by detaching end portion 22 of tray 12.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An apparatus for collapsing and collecting a can, comprising:

a. a housing, said housing including a press movable between a first position and a second position, said housing further including a guide; and b. a tray, said tray including a first portion with a surface and a second portion with an opening therethrough, said housing guide accommodating said tray for movement to selectively place said first portion and said second portion of said tray in opposition to said press, said press movement toward said first portion of said tray at least partially collapsing the can when the can lies on said first portion surface of said tray, said can passing through said tray second portion opening when said tray second portion is placed in opposition to said press.

2. The apparatus of claim 1 which further comprises a container and means for holding said container to said tray at said opening of said second portion of said tray.

3. The apparatus of claim 2 in which said means for holding said container to said tray comprises a flange extending from said tray, said flange engaging a portion of said container to support said container to said tray.

4. The apparatus of claim 3 in which said engaging of said flange and a portion of said container comprises a sliding engagement.

5. The apparatus of claim 3 in which said means for holding said container to said tray further comprises means for detachably holding said container to said tray.

6. The apparatus of claim 5 in which said engaging of said flange and a portion of said container comprises a sliding engagement.

7. The apparatus of claim 2 in which said tray includes a first side and an opposite second side, said surface of said first portion of said tray lying on said tray first side and said container protracts from said second side of said tray.

8. The apparatus of claim 7 in which said means for holding said container to said tray comprises a flange extending from said tray, said flange engaging a portion of said container to support,said container to said tray.

9. The apparatus of claim 8 in which said engaging of said flange and a portion of said container comprises a sliding engagement.

10. The apparatus of claim 8 in which said means for holding said container to said tray further comprises means for detachably holding said container to said tray.

11. The apparatus of claim 10 in which said engaging of said flange and a portion of said container comprises a sliding engagement.

* * * * *